US007438441B2

(12) United States Patent
Sun et al.

(10) Patent No.: US 7,438,441 B2
(45) Date of Patent: Oct. 21, 2008

(54) LIGHT EMITTING LIGHT DIODE LIGHT TUBE

(75) Inventors: Tsung-Ting Sun, Taipei Hsien (TW); Hung-Ta Liao, Taipei Hsien (TW); Tzu-Hsuan Yen, Taipei Hsien (TW); Pao-Shen Chen, Taipei Hsien (TW)

(73) Assignee: Edison Opto Corporation, Taipei Hsien (TW)

( * ) Notice: Subject to any disclaimer, the term of this patent is extended or adjusted under 35 U.S.C. 154(b) by 16 days.

(21) Appl. No.: 11/723,919

(22) Filed: Mar. 22, 2007

(65) Prior Publication Data

US 2008/0158870 A1 Jul. 3, 2008

(30) Foreign Application Priority Data

Dec. 29, 2006 (TW) ..... 95223251 U

(51) Int. Cl.
*F21V 29/00* (2006.01)

(52) U.S. Cl. ..... 362/294; 362/648; 362/345; 362/218

(58) Field of Classification Search ..... 362/293–294, 362/240, 244, 309–311, 640, 646–648, 300, 362/334, 331–332, 338, 345, 347, 227, 19, 362/218–219
See application file for complete search history.

(56) References Cited

U.S. PATENT DOCUMENTS 3,693,530 A * 9/1972 Larkfeldt et al. ..... 454/248
5,184,881 A * 2/1993 Karpen ..... 362/1
5,746,502 A * 5/1998 Huang ..... 362/223
D500,883 S * 1/2005 Herst et al. ..... D26/118
6,853,151 B2 * 2/2005 Leong et al. ..... 315/185 R
6,997,576 B1 * 2/2006 Lodhie et al. ..... 362/240
2003/0048641 A1 * 3/2003 Alexanderson et al. ..... 362/470
2004/0012959 A1 * 1/2004 Robertson et al. ..... 362/247
2004/0062041 A1 * 4/2004 Cross et al. ..... 362/240
2005/0207166 A1 * 9/2005 Kan et al. ..... 362/373
2005/0243576 A1 * 11/2005 Park et al. ..... 362/612
2006/0146531 A1 * 7/2006 Reo et al. ..... 362/244
2008/0037245 A1 * 2/2008 Chan ..... 362/218

* cited by examiner

*Primary Examiner*—Jong-Suk (James) Lee
*Assistant Examiner*—Julie A. Shallenberger
(74) *Attorney, Agent, or Firm*—Birch, Stewart, Kolasch & Birch, LLP

(57) ABSTRACT

A Light Emitting Diode (LED) light tube is applied to be directly inserted to two pairs of electrode insertion holes of a fluorescent light tube fixture to replace a fluorescent tube. The LED light tube comprises a heat-dissipating base, a plurality of linear-extend LEDs and a light-transmissible shell, wherein an arrangement surface of the heat-dissipating base is arranged with the linear-extend LEDs, a peripheral surface of the heat-dissipating base is formed with a plurality of heat-dissipating grooves, two end-surfaces of the heat-dissipating base are respectively connected a pairs of electrodes to be inserted into the electrode insertion holes, and the light-transmissible shell including an opening for covering and assembling to the arrangement surface to package the linear-extend LEDs with the heat-dissipating base.

18 Claims, 5 Drawing Sheets

LIGHT EMITTING LIGHT DIODE LIGHT TUBE

FIELD OF THE INVENTION

The present invention relates to a light emitting diode (LED) light tube, and more particularly to an LED light tube applied to be assembled to a fluorescent light tube fixture for replacing a fluorescent light tube.

BACKGROUND OF THE INVENTION

In daily life, for exactly identifying environment and directions in the dark, illumination devices have already been a kind of indispensable tools. Most of the existed illumination devices have a light tube or a bulb served as a light source, and more familiar, the light tube or light bulb may be a fluorescent light tube, an incandescent light bulb, a halogen light tube or a halogen light bulb and so on. Among the light tubes or bulbs, the fluorescent light tube are widely used by the most people due to the reasons of the power consumption of the fluorescent light tube is one quarter of that of the incandescent light bulb, the working life of the fluorescent light tube is 5 to 10 times of that of the incandescent light bulb, the fluorescent light tube can provide homogeneous illumination, and the fluorescent light tube can be used for wide-angle illumination. Following up, we will disclose the structure and the working principle of a fluorescent light assembly.

Please refer to FIG. 1, which illustrates a perspective view of a fluorescent light tube and a fluorescent light tube fixture. As shown in FIG. 1, a fluorescent light assembly 100 includes a fluorescent light tube 1 and a fluorescent light tube fixture 2. The fluorescent light tube 1 includes a tube body 11, and a pair of metal end-portions 12 and 13. The metal end-portion 12 has a pair of electrode contacts 121 and 122, and the metal end-portion 13 has a pair of electrode contacts 131 and 132.

The fluorescent light tube fixture 2 includes a fixture body 21, a pair of electrode holders 22 and 23 and a starter 24. The electrode holder 22 is arranged neighbor to one end of the fixture body 21 and has a pair of electrode insertion holes 221 and 222; and the electrode holder 23 is arranged neighbor to the other end of the fixture body 21 and has a pair of electrode insertion holes 231 and 232. The starter 24 is arranged near the electrode holder 22 or 23.

When assembling the fluorescent light assembly 100, the electrode contacts 121 and 122 of the fluorescent light tube 1 are respectively inserted to the electrode insertion holes 221 and 222, and the electrode contacts 131 and 132 of the fluorescent light tube 1 are respectively inserted to the electrode insertion holes 231 and 232 to communicate with a specified circuit. When triggering the fluorescent light assembly 100 lighting, the electrons released form the electrodes impact the particles, which are usually the particles of mercury vapor within the fluorescent light tube to stimulate the phosphor, coated on the inner surface of the fluorescent light tube, projecting white light. However, the phosphor distributed on the inner surface of the fluorescent light tube usually contains heavy metals, such as mercury, so that it is difficult to be recycled and makes more pollution problems.

Besides, since the LED has the advantages of lightweight, less volume, low power consumption, and long working life, etc., it is gradually used to illumination devices. Following up, we will provide brief description about the lighting principle of the LED. The lighting principle of LED is translating electric power to light energy, that is, doping a minute amount of carriers into a conjunction of P-type side and N-type side and continuously combining the minute amount of carriers with a major amount of carriers to form a LED. To be with the good performance of the LED radiation may need a large amount of pairs of electrons and holes.

The space charge layers become narrower when applying a forward biased voltage, and then a major amount of carriers are doped into the P-type side and the N-type side according to Fermi characteristic energy level deviation. Due to that the minute amount of carriers are increased on the P-type side and N-type side, the pairs of electrons and holes located on the P-type side and the N-type side are recombined to release sufficient photons. In the present, the categories of LED generally include AlGaP and GaN series.

Additionally, although the electric power consumption of the fluorescent light is just one quarter of the incandescent light, the working life of the fluorescent light is five to ten times of the incandescent light. But the electric power consumption of the LED is just one eighth of the incandescent light, and the working life of the fluorescent light is fifty to one hundred times of the incandescent light. Comparing with the fluorescent light, the LED not only can save electric power and work in a long life, but also can work in a lower lighting temperature.

SUMMARY OF THE INVENTION

The problems intend being solved in the present invention and the objects of the present invention are described as follows:

Summarizing above description, since the LED has the advantages of lower electric power consumption, longer working life, and lower lighting temperature with respect to the fluorescent lamp, therefore, if the problem of the illumination not homogenous enough has been overcome, the LED will have more commercial values to replace the fluorescent light and be applied in wide-angle illumination devices.

Thus, the primary object of the present invention provides a LED light tube compatible to, both in electrical and in spatial, the existed fluorescent light tube fixture, so that it can directly replace the fluorescent light tube, without refitting the fluorescent light tube fixture, to have the advantages of lower electric power consumption, longer working life, and lower lighting temperature.

The secondary object of the present invention provides a LED light tube having grained patterns, so that the LED light tube can provide homogenous illumination after being communicating with power supply.

Means of the present invention for solving problems:

Means of the present invention for solving the problems as mentioned above provide an LED light tube applied to be directly assembled to two pair of electrode insertion holes of an existed fluorescent light tube fixture to replace a fluorescent light tube. The LED light tube includes a heat-dissipating base, a plurality of linear-extended LEDs and a light-transmissible shell. An arrange surface of the heat-dissipating base is provided for the linear-extended LEDs, a first peripheral-surface of the heat-dissipating base is formed with a plurality of heat-dissipating grooves, each one of the two end-surfaces of the heat-dissipating base is respectively protruded with a pair of electrode contacts for assembling to the electrode insertion holes. The light-transmissible shell matching to the heat-dissipating base includes an opening for assembling to the arrangement surface to package the plurality of linear-extend LEDs with the heat-dissipating base.

In a preferred embodiment of the present invention, the LED light tube is compatible to the existed fluorescent light tube fixture, not only in electrical but also in spatial. Furthermore, the light-transmissible shell is formed with a plurality of grained patterns and has the performance of light filtering, polarization, concentration and anti-glare.

Effects of the present invention with respect to prior arts:

Make a comparison between the LED light tube of the present invention and the fluorescent light tube, the power consumption of the LED light tube is one half of that of the fluorescent light tube, while the working life of the LED light tube can reaches to ten times of that of the fluorescent light tube. Besides, the LED light tube can reduce pollution toward environment due to that no phosphor with polluted heavy metal element is necessary to be coated within LED light tube. Thus, making a summary of above description, the means of the present invention not only can provide homogenous illumination, but also can provide the effects of reducing power consumption, increasing working life and reducing pollution toward environment.

The devices, characteristics, and the preferred embodiment of this invention are described with relative figures as follows.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Due to that the light emitting diode (LED) light tube as provided in accordance with the present invention can be directly assembled to a fluorescent light tube fixture, the combined applications are too numerous to be enumerated and described, so that we only disclose two preferred embodiments for representation.

Figure 1:
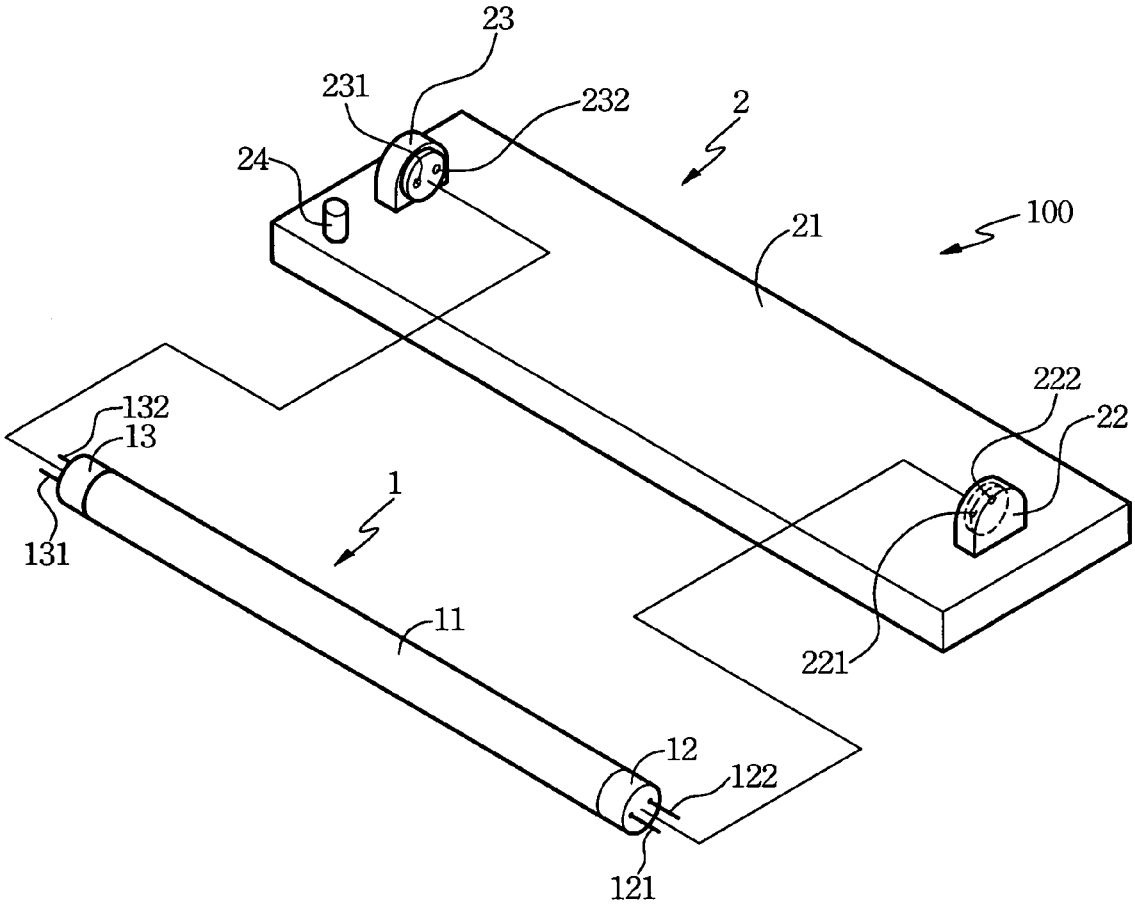
F I G . 1 (Prior Art)
FIG. 1 illustrates a perspective view of a fluorescent light tube and a fluorescent light tube fixture.
Figure 2:
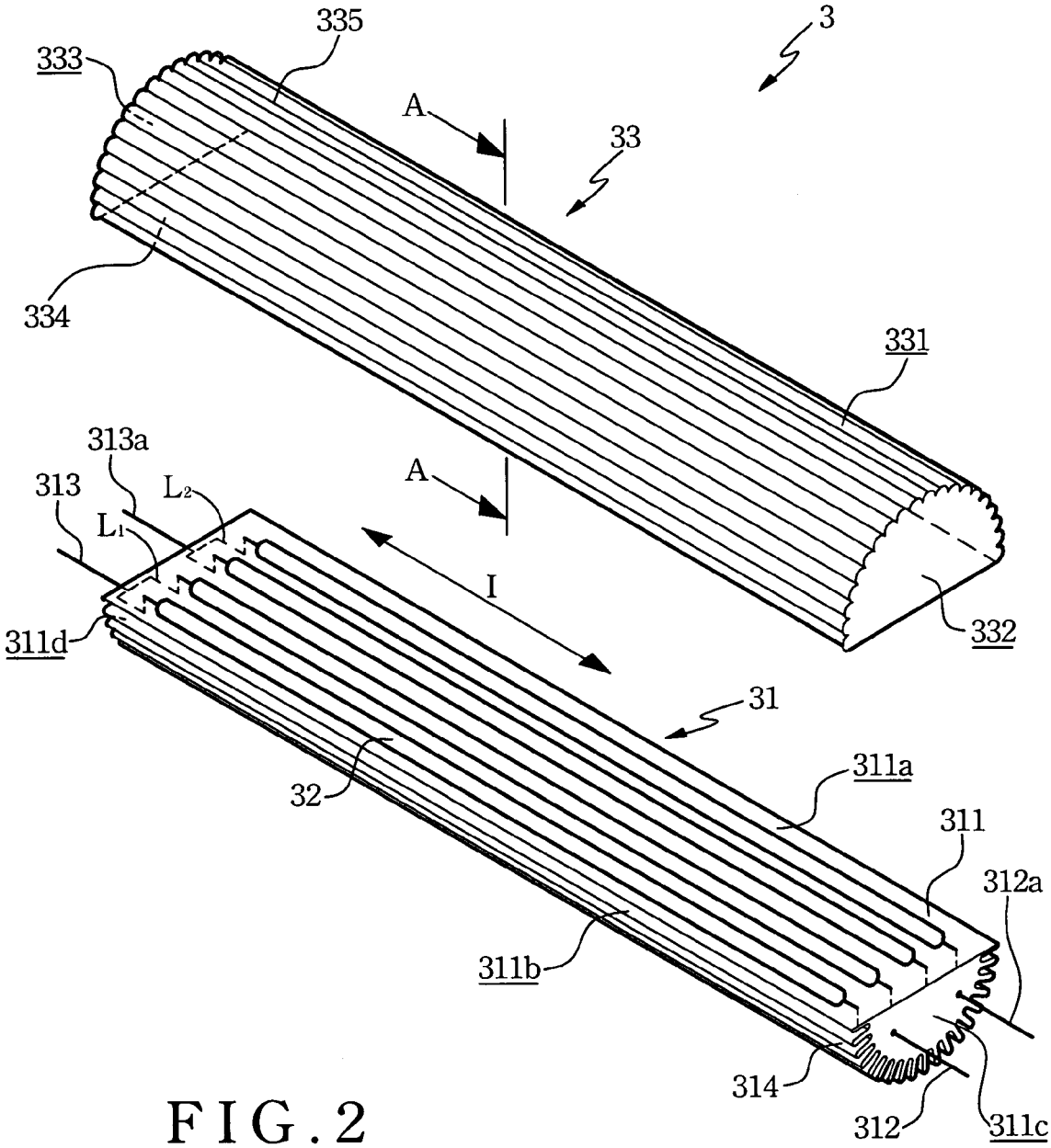
FIG. 2 illustrates a perspective view of a first embodiment of the LED light tube in accordance with the present invention, with the transparent shell lifted off.
Figure 3:
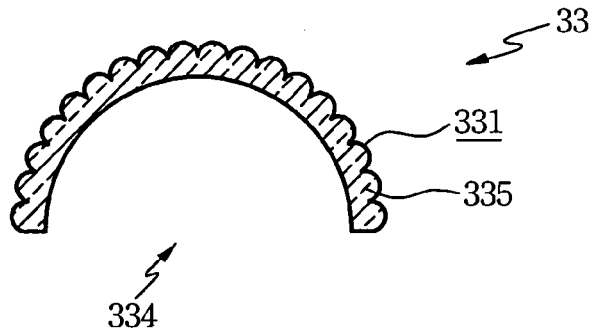
FIG. 3 illustrates a sectional view of the light-transmissible shell along line A-A of FIG. 2.
Figure 4:
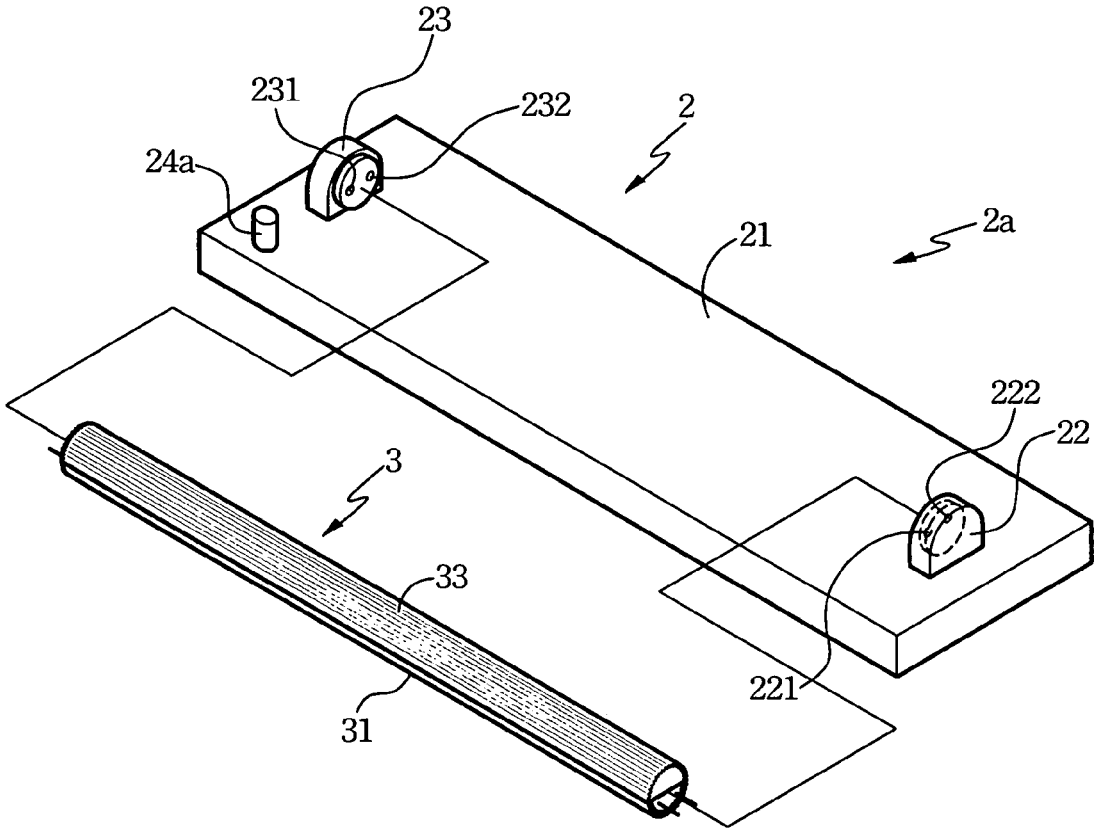
FIG. 4 illustrates a perspective view of the first embodiment in accordance with the present invention and a fluorescent light tube fixture.

Please refer to FIG. 2 to FIG. 4, wherein FIG. 2 illustrates a perspective view of a first embodiment of the LED light tube in accordance with the present invention, with the transparent shell lifted off, FIG. 3 illustrates a sectional view of the light-transmissible shell along line A-A of FIG. 2, and FIG. 4 illustrates a perspective view of the first embodiment in accordance with the present invention and a fluorescent light tube fixture. As shown in above figures, a LED light tube 3 is directly assembled to a fluorescent light tube fixture 2*a* to project an illumination light beam for replacing the fluorescent light tube 1 shown in FIG. 1. Except for using an LED driver 24*a* being used for replacing the starter 24, the rest elements of the fluorescent light tube fixture 2*a* are the same as those of the fluorescent light tube fixture 2 as mentioned above, so that we just present all relative elements in above figures.

LED light tube 3 includes a heat-dissipating base 31, a plurality of linear-extended LEDs 32 and a light-transmissible shell 33. The heat-dissipating base includes a base body 311, a pair of electrode contacts 312 and 312*a*, another pair of electrode contacts 313 and 313*a*, and a plurality of heat-dissipating grooves 314. The base body is substantially composed of heat-conductive material, extended along an extension direction I, and having an arrangement surface 311*a*, a first peripheral surface 311*b* and two first end-surfaces 311*c* and 311*d*. In this embodiment, the heat-dissipating base 311 is specially shaped as a semi-cylindrical structure.

The electrode contacts 312 and 312*a* are protruded from the first end-surface 311*c* for inserting to the electrode insertion holes 221 and 222. The electrode contacts 313 and 313*a* are protruded from the first end-surface 311*d* for inserting to the electrode insertion holes 231 and 232. The heat-dissipating grooves 314 are formed on the first peripheral surface 311*b*, furthermore, they are formed from the first end-surface 311*c*, extended along the extension direction I, to the first end-surface 311*d* for dissipating lighting heat generated when projecting the illumination light beam.

The linear-extended LEDs 32 are arranged on the arrangement surface 311*a*, and each one of the linear-extended LEDs 32 is parallel to the extension direction I and apart from each other. In the first embodiment, the linear-extended LEDs 32 are arranged to form two illumination circuits $L_1$ and $L_2$ connected with each other in a parallel connection, wherein two ends of the illumination circuits $L_1$ are connected to the electrode contacts 312 and 313 respectively, and two ends of the illumination circuits $L_2$ are connected to the electrode contacts 312*a* and 313*a* respectively.

The light-transmissible shell 33 matching to the heat-dissipating base 31 can be composed of light-transmissible material, such as light-transmissible glass, acrylic, or plastic. Meanwhile, the light-transmissible shell 33 is extended along the extension direction I, and has a second peripheral surface 311, two second end-surfaces 332 and 333, an opening 334 and a plurality of grained patterns 335.

The grained patterns 335 are distributed on the second peripheral surface 331, furthermore, they are formed from the second end-surface 332, extended along the extension direction I, to the second end-surface 333 to modulate the illumination light beam projected form the linear-extended LEDs 32 for making the illumination light beam more homogenous. Moreover, the opening 334 is removable to be covered and assembled to the arrangement surface 311*a* for packaging the linear-extended LEDs 32 with the heat-dissipating base 31.

In the first embodiment, the light-transmissible shell 33 is shaped as a semi-cylindrical shell structure with a cross section as shown in FIG. 3, so that when the opening 334 of the light-transmissible shell 33 assembles to the arrangement surface 311*a* to package the LEDs 32, the light-transmissible shell 33 and the heat-dissipating base 31 respectively shaped as the semi-cylindrical shell structure and the semi-cylindrical shell structure can make the LED light tube 3 be shaped as a cylindrical structure. Thus, the LED light tube 3 can be provided with overall dimensions similar to the fluorescent light tube 1 as shown in FIG. 1, so that the LED light tube 3 is spatially compatible to the fluorescent light tube fixture 2*a*.

Besides, the heat-dissipating base 31 further can be connected with proper circuits, the LEDs 32 can be provided with specified resistance, so that the LED light tube 3 can be provided with electrical parameters equivalent to the fluorescent light tube 1 to make the LED light tube 3 be electrically compatible to the fluorescent light tube fixture 2*a*. Under the same illumination, due the power consumption of the LEDs 32 is approximate to one half of that of the fluorescent light tube, so that it the heat-dissipating base 31 can be arranged with proper voltage-dividing circuits, voltage-down circuits, voltage-transformation circuits or other modulation circuits complied with safety standard, so that the LED light tube 3 can reduce power consumption with respect to the fluorescent light tube 1. From above description, the LED light tube 3 of the present invention is compatible to the fluorescent tube fixture 2*a* both in spatial and electrical, so that it can directly replace the fluorescent light tube without refitting the existed fluorescent light tube fixture.

Figure 5:
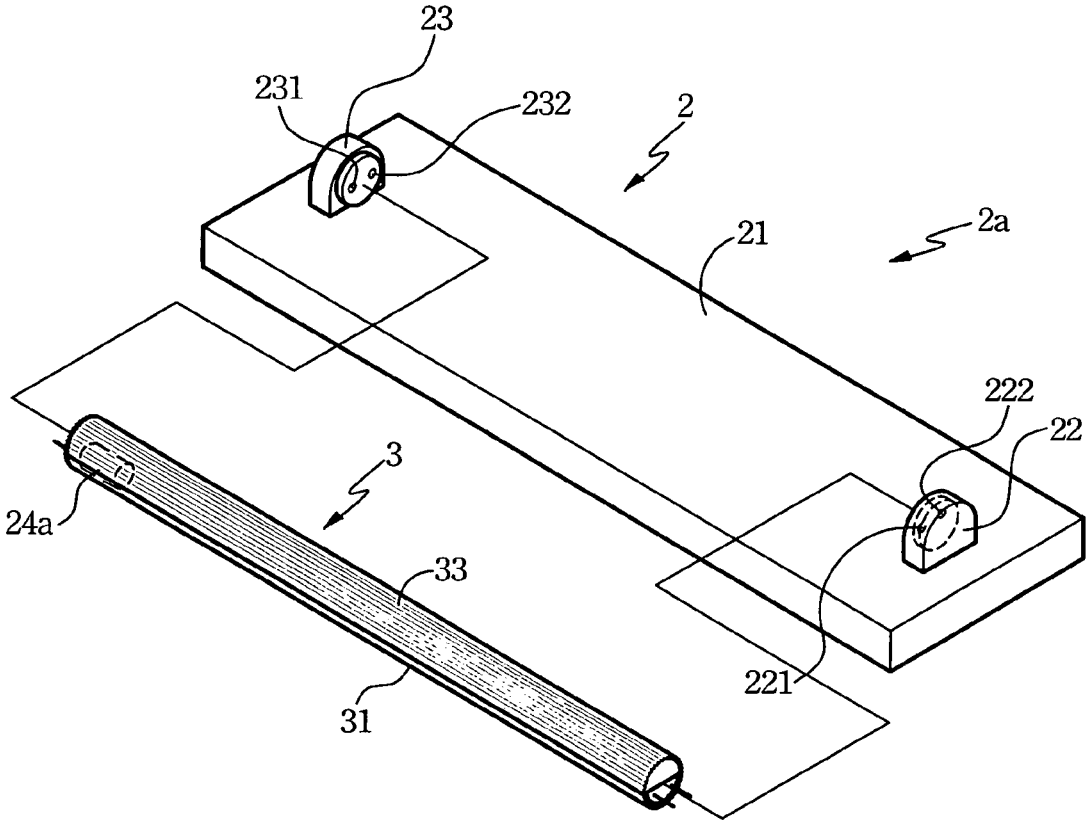
FIG. 5 illustrates a perspective view of the first embodiment in accordance with the present invention and a conventional tube fixture; in particular, presenting an LED driver can be directly arranged in a heat-dissipating base.

People skilled in relative arts can easily realize it is still necessary to use an LED driver 24*a* to replace the starter 24 of the prior art for driving the linear-extended LEDs 32 projecting the illumination light beam. While in real application, the LED driver 24*a* can be directly arranged in the heat-dissipating base 31 (as shown in FIG. 5) to directly drive the linear-extended LEDs 32 projecting illumination light beam. Thus, it is unnecessary to assemble the LED driver 24*a* to the fluorescent light tube fixture 2*a*, so that it can further provide more convenience of assembling and use.

Additionally, the light-transmissible shell 33 itself can be a structure of light filtering and polarization, so that the illumination light beam projected from the linear-extended LEDs 32 can have specified color, polarization and optical rotation. For example, the illumination light beam can be a yellow polarized light beam or a red light beam with left optical rotation. Of course, the light-transmissible shell 33 itself can be a structure of light concentration or anti-glare, so that the LED light tube 3 can provide more comfortable and diversification illumination. Due to that the opening 334 of the light-transmissible shell is removable to the arrangement surface 311*a* of the base body 311 of the heat-dissipating base 31, so that it is able to fit the light-transmissible shell with specified performance of light filtering, polarization, concentration and anti-glare according the diversification requirements of illumination.

Figure 6:
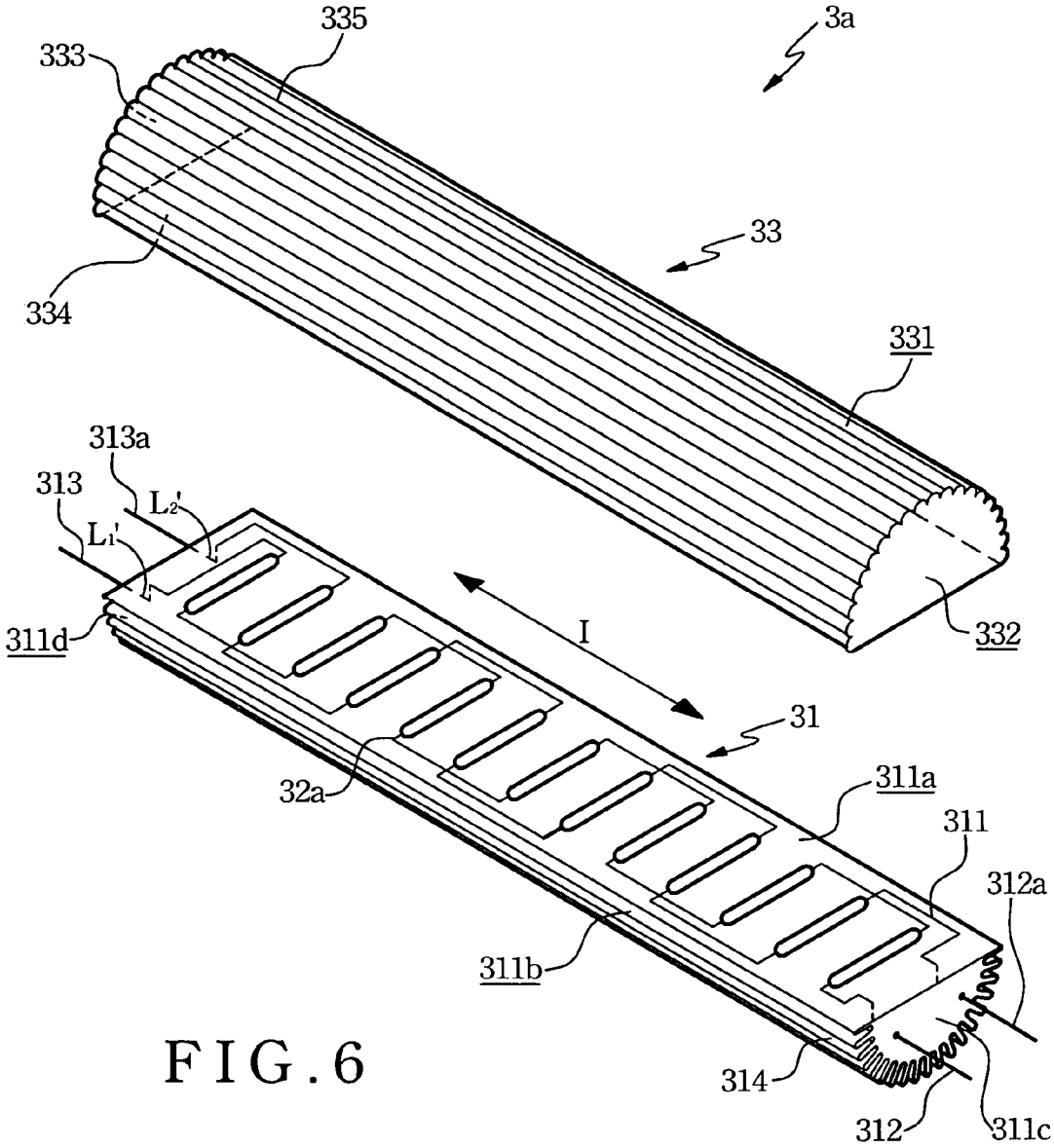
FIG. 6 illustrates a perspective view of a second embodiment of the LED light tube in accordance with the present invention, with the light-transmissible shell lifted off.

Please refer to FIG. 6, which illustrates a perspective view of a second embodiment of the LED light tube in accordance with the present invention, with the light-transmissible shell lifted off. As shown in FIG. 6, in the second embodiment, another LED light tube 3*a* is provided to replace the LED light tube 3, wherein a plurality of linear-extended LEDs 32*a* are provided to replace the linear-extended LEDs 32 of the LED light tube 3, and the arrangement of the linear-extended LEDs 32*a* is also different from that of the linear-extended LEDs 32. Excepting for above differences, the rest elements of the LED light tube are similar to or the same as those of the LED light tube 3.

As shown in FIG. 5, the linear-extended LEDs 32*a* are arranged on the arrangement surface 311*a*, and each one of the linear-extended LEDs 32 is vertical to the extension direction I and apart from each other. In the second embodiment, the linear-extended LEDs 32*a* are arranged to form two illumination circuits $L_1'$ and $L_2'$ connected with each other in a parallel connection, wherein two ends of the illumination circuits $L_1'$ are connected to the electrode contacts 312 and 313 respectively, and two ends of the illumination circuits $L_2'$ are connected to the electrode contacts 312*a* and 313*a* respectively.

For being easily manufactured and meeting specified requirements, the plurality of linear-extended LEDs 32 and 32*a* can be made by connecting a plurality of short linear LEDs. Furthermore, the arrangement method of the linear-extended LEDs is not limited by the disclosed two embodiments, i.e., being arranged parallel or vertical to the extension direction I. In real applications, the linear-extended LEDs 32 and 32*a* can be arranged on the arrangement surface 311*a* via 3-dimensional crossing and other possible combined connection methods.

Although the present invention has been described with reference to the preferred embodiments thereof, it is apparent to those skilled in the art that a variety of modifications and changes may be made without departing from the scope of the present invention which is intend to be defined by the append claims.

What is claimed is:

1. A light emitting Diode (LED) light tube applied to be directly assembled to two pairs of electrode insertion holes of a fluorescent light tube fixture to replace a fluorescent light tube for projecting an illumination light beam, and comprising:

a heat-dissipating base extended along an extension direction, and comprising:

a base body substantially composed of a heat-conductive material, and having an arrangement surface, a first peripheral-surface and two first end-surfaces;

two pairs of electrode contacts respectively protruded from the two first end-surfaces for assembling to the two pairs of electrode insertion holes; and a plurality of heat-dissipating grooves formed on the first peripheral surface for dissipating a lighting heat generated when projecting the illumination light beam;

a plurality of linear-extended LEDs arranged on the arrangement surface; and a light-transmissible shell extended along the extension direction, matching to the heat-dissipating base, and having an opening for assembling to the arrangement surface to package the plurality of linear-extend LEDs with the heat-dissipating base.

2. The LED light tube as claimed in claim 1, wherein each one of the linear-extend LEDs is made by connecting a plurality of short linear LEDs.

3. The LED light tube as claimed in claim 1, wherein the heat-dissipating base is shaped as a semi-cylindrical structure, and the heat-dissipating grooves are formed from one of the first end-surfaces, extended along the extension direction, to the other one of the first end-surfaces.

4. The LED light tube as claimed in claim 3, wherein the light-transmissible shell is shaped as another semi-cylindrical shell structure for forming the LED light tube alike a cylinder structure after being assembled with the heat-dissipating base.

5. The LED light tube as claimed in claim 1, wherein the light-transmissible shell further comprises a second peripheral surface and a plurality of grained patterns distributed on the second peripheral surface for modulating the illumination light beam.

6. The LED light tube as claimed in claim 5, wherein the light-transmissible shell further comprises two second end-surfaces, and the grained patterns are formed from one of the second end-surfaces, extended along the extension direction, to the other one of the second end-surfaces.

7. The LED light tube as claimed in claim 5, wherein the light-transmissible shell is removable to be covered and assembled to the arrangement surface.

8. The LED light tube as claimed in claim 5, wherein the light-transmissible shell is a structure of light filtering.

9. The LED light tube as claimed in claim 5, wherein the light-transmissible shell is a structure of light polarization.

10. The LED light tube as claimed in claim 5, wherein the light-transmissible shell is a structure of light-concentration.

11. The LED light tube as claimed in claim 5, wherein the light-transmissible shell is a structure of anti-glare.

12. The LED light tube as claimed in claim 1, wherein each one of the plurality of linear-extend LEDs is arranged parallel to the extension direction and apart from each other.

13. The LED light tube as claimed in claim 1, wherein each one of the plurality of linear-extend LEDs is arranged vertical to the extension direction and apart from each other.

14. The LED light tube as claimed in claim 1, wherein the light-transmissible shell is made of a light-transmissible glass material.

15. The LED light tube as claimed in claim 1, wherein the light-transmissible shell is made of a light-transmissible acrylic material.

16. The LED light tube as claimed in claim 1, wherein the light-transmissible shell is made of a light-transmissible plastic material.

17. The LED light tube as claimed in claim 1, wherein an LED driver is arranged on the fluorescent light tube fixture for driving the linear-extend LEDs projecting the illumination light beam.

18. The LED light tube as claimed in claim 1, wherein an LED driver is arranged on the heat-dissipating base for driving the linear-extend LEDs projecting the illumination light beam.

* * * * *